US005378032A

United States Patent [19]

Agnew et al.

[11] Patent Number: 5,378,032

[45] Date of Patent: Jan. 3, 1995

[54] WIRE JAW STONEHOLDER

[75] Inventors: Richard C. Agnew, Norwalk; Robert Van Den Heuvel, Culver City, both of Calif.

[73] Assignee: GIA Gem Instruments Corporation, Santa Monica, Calif.

[21] Appl. No.: 200,922

[22] Filed: Feb. 22, 1994

Related U.S. Application Data

[63] Continuation of Ser. No. 44,275, Apr. 7, 1993, abandoned, which is a continuation of Ser. No. 825,200, Jan. 24, 1992, Pat. No. 5,242,203.

[51] Int. Cl.[6] ..... B25B 9/00; G04D 1/02

[52] U.S. Cl. ..... 294/99.2; 81/7

[58] Field of Search ..... 294/1.2, 3, 7, 8.5, 294/11, 33, 99.1, 99.2, 100, 902; 81/6, 7, 8

[56] References Cited

U.S. PATENT DOCUMENTS

| | | | |
|---|---|---|---|
| 573,574 | 12/1896 | Davies . | |
| 612,813 | 10/1898 | Bickford . | |
| 1,228,945 | 6/1917 | Miskimen . | |
| 1,276,406 | 8/1918 | Pejchar . | |
| 1,311,414 | 7/1919 | Osher . | |
| 1,411,316 | 4/1922 | Vestal . | |
| 2,217,319 | 10/1940 | Poole et al. . | |
| 2,309,050 | 1/1943 | Dinhofer . | |
| 2,332,283 | 10/1943 | Weiner . | |
| 2,612,735 | 10/1953 | Lea . | |
| 2,757,951 | 8/1956 | Benton . | |
| 2,934,993 | 5/1960 | Chromy . | |
| 3,162,474 | 12/1964 | Lefebvre . | |
| 3,420,563 | 1/1969 | Witt . | |
| 4,580,909 | 4/1986 | McIntosh | 294/99.2 X |

FOREIGN PATENT DOCUMENTS

| | | | |
|---|---|---|---|
| 669679 | 3/1989 | Switzerland . | |
| 119313 | of 1918 | United Kingdom . | |
| 454171 | 9/1936 | United Kingdom | 294/99.2 |

*Primary Examiner*—Dean J. Kramer

*Attorney, Agent, or Firm*—Lyon & Lyon

[57] ABSTRACT

An improved stoneholder for supporting diamonds and other gemstones comprising a pair of clasping members and a pair of respective clasp mounts. Each clasping member comprises a pair of stone support members which are joined at a distal end, separated by an aperture, and mounted to one of the respective clasp mounts at a proximal end.

1 Claim, 2 Drawing Sheets

WIRE JAW STONEHOLDER

This is a divisional continuation of co-pending application Ser. No. 08/044,275, filed on Apr. 7, 1993 and which designated the U.S. now abandoned which is a continuation of Ser. No. 07,825,200 filed, now U.S. Pat. No. 5,242,203.

BACKGROUND OF THE INVENTION

The field of the present invention is stoneholders of the type generally used by gemologists.

Stoneholders and other tweezer like devices have been used by gemologists for many years for the handling of diamonds and other precious gems. For example, when viewing a stone under a microscope, a gemologist will generally clasp a stone girdle to girdle between the jaws of a stoneholder and position the stone above the stage of the microscope. Next, the gemologist will adjust the microscope to insure that the stone is properly illuminated for viewing. However, because traditional stoneholders generally comprise a pair of stamped or moulded metal clasping members which resemble the jaws of an alligator clip, these stoneholders have a tendency to shroud a stone and to inhibit its illumination. Ordinarily, this shrouding constitutes only a minor impediment to the proper illumination of a stone because the majority of the light illuminating the stone enters the stone through its upper or lower surface. In contrast, when a stone is viewed against a dark field background, substantially all of the light illuminating the stone must enter through the sides of the stone, and the shrouding produced by the solid metal clasping members of traditional stoneholders becomes significant.

SUMMARY OF THE INVENTION

The present invention is directed to an improved stoneholder for viewing gemstones and the like. To this end, an exemplary embodiment of the stoneholder employs a pair of springwire clasping members which provide a means for holding a gemstone or the like. Each clasping member comprises a unitary piece of springwire bent at a central portion to form two parallel stone supporting members separated by an aperture. The free ends of the stone supporting members are mounted to respective clasp mounts, and the clasp mounts are operatively coupled such that the respective clasping members oppose each other and are moveable toward and from each other. Accordingly, when a stone is held between the clasping members of a stoneholder employing an embodiment of the present invention, increased illumination is provided to the stone through the aperture between the stone supporting members. Further, the springwire construction of the clasping members minimizes any shrouding of the stone.

In a preferred form, the clasping members are constructed such that the bend joining the stone supporting members comprises a substantially circular seat for supporting the cutlet of a stone. This design allows a stone to be held table to cutlet by the clasping members and rotated as a wheel about its central axis.

Accordingly, it is an object of the present invention to provide an improved stoneholder for viewing gemstones and the like.

BRIEF DESCRIPTION OF THE DRAWING

FIG. 2(*b*) is a top view of a clasping member embodying a preferred form of the invention.

DESCRIPTION OF THE PREFERRED EMBODIMENT

Figure 1:
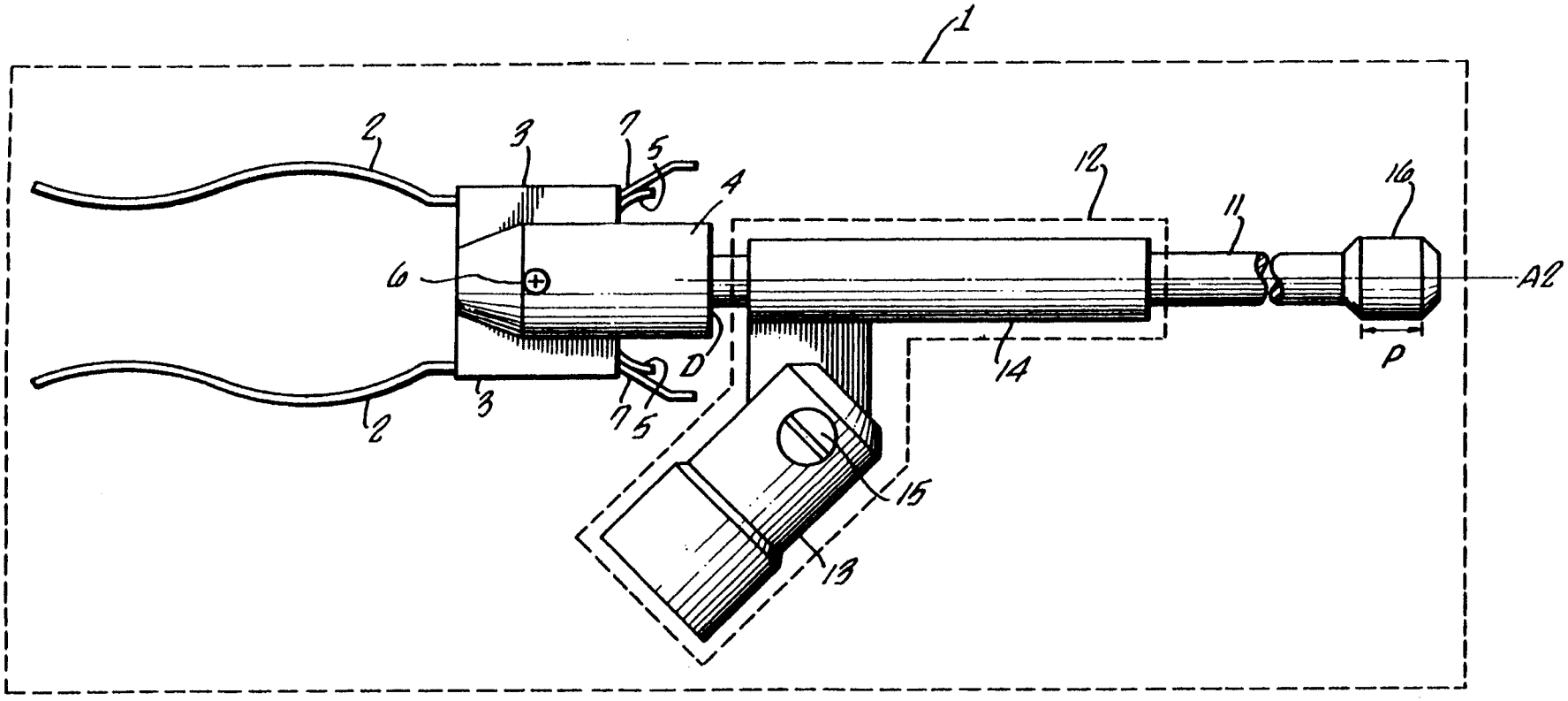
FIG. 1 is a top view of a stoneholder employing a preferred embodiment of the invention.

Turning in detail to the drawings, a stoneholder in accordance with a preferred form of the present invention is illustrated in FIG. 1. As illustrated, the stoneholder 1 comprises a pair of clasping members 2, a pair of clasp mounts 3, a casing 4, a spring 5, and a retaining pin 6.

The clasping members 2 are mounted to the clasp mounts 3 which are operatively coupled by the retaining pin 6 within the casing 4 such that the clasping members 2 oppose each other and are moveable toward and from each other. In use, the clasping members 2 of the stoneholder 1 function in the same manner as do the jaws of a common alligator clip. Specifically, the opening and closing of the clasping members 2 is controlled in combination by the spring 5 and the application of force to respective flared portions 7 of the clasp mounts 3. The spring 5 applies a constant force to the clasp mounts 3 causing constant tension to result between the clasping members 2. However, when sufficient force is applied to the flared portions 7 of the clasp mounts 3, the force causes the clasping members 2 to separate and move apart. FIG. 1 illustrates the clasping members 2 in their "open" position (i.e. with force applied to the flared portions 7 of the clasp mounts 3). When the force is removed, tension again results between the clasping members 2.

Figure 2B:
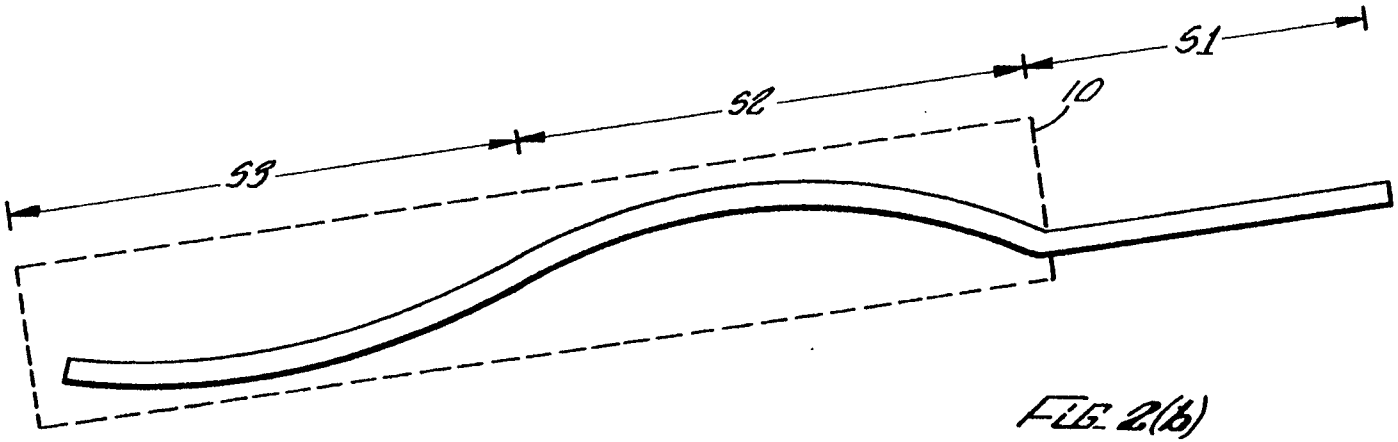
FIG. 2(*a*) is a side view of a clasping member embodying a preferred form of the invention.
Figure 2A:
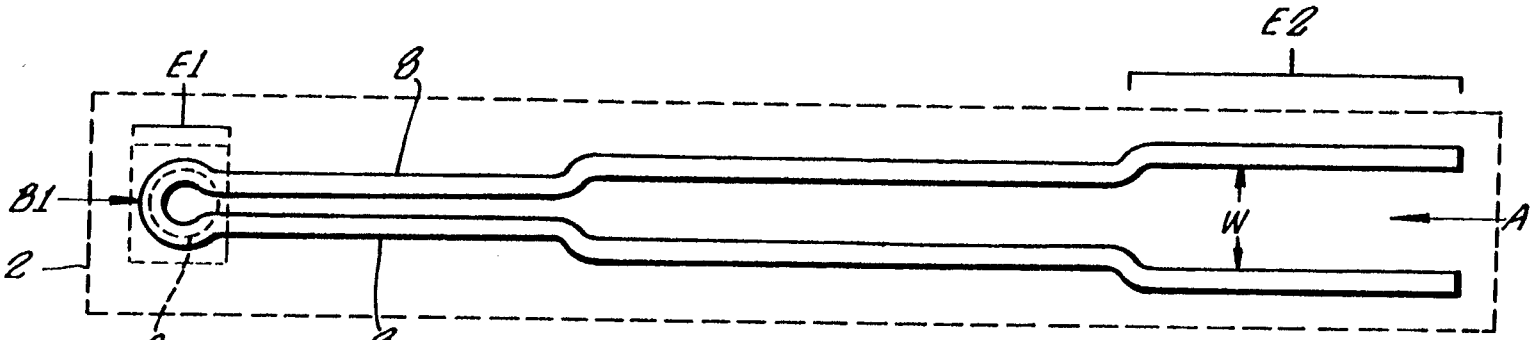

Turning now to FIG. 2(*a*), each clasping member 2 comprises a unitary piece of springwire bent at a central portion to form two parallel stone supporting members 8 joined at one end E1 by the bend B1, and separated by an aperture A. At the other end E2, the clasping members 2 are mounted to the clasp mount 3, as shown in FIG. 1.

In a preferred form, the bend B1 joining the stone supporting members 8 is substantially circular in shape. Thus, a seat 9 is provided within which the cutlet of a stone may be placed should an observer wish to hold the stone by its table and cutlet for viewing. In this position the stone may be rotated 360 degrees about its axis.

In another preferred form, illustrated in FIG. 2(*b*), the clasping members 2 have a shape which may be described in three sections S1–3 comprising a first linear section S1 and two curved sections 82 and S3. The linear section S1 of each clasping member 2 is mounted within the clasp mount 3, and the remaining sections S2 and S3 form an "S-shaped" jaw structure 10. Further, as shown in FIG. 2(*a*), to provide increased stability and allow the stoneholder 1 to accommodate a wider variety of stone sizes, the width W of the aperture A between the stone supporting members 8 is varied from section to section, the width being greatest in the linear section S1 and smallest in the most extended section S3 of the jaw structure 10.

Turning again to FIG. 1, in still another form the stoneholder 1 further comprises a support rod 11 and a trunnion assembly 12 comprising a base 13 and a trunnion tube 14 operatively coupled by a hinge joint 15. The support rod 11 slides within the trunnion tube 14 and has a distal end D which is mounted to the casing 4 of the stoneholder 1 and a proximal end P which is threaded to engage a knob 16. The knob 16 secures the support rod within the trunnion tube 14, and the base 13 is adapted to engage a tensioned boss or pivot (not shown) located on a microscope stage. Thus, when a stone is viewed under a microscope (not shown), the stoneholder 1 may be attached to the stage of the microscope by sliding the base 13 of the trunnion assembly 12 over the tensioned boss located on the microscope stage, and the position of the stone may be adjusted by sliding the rod 11 along its axis A2, rotating the rod 11 about its axis A2, pivoting the rod 11 about the stage boss, and pivoting the rod 11 with respect to the hinge joint 15.

While the invention is susceptible to various modifications and alternative forms, a specific example has been shown in the drawings and is herein described in detail. It should be understood, however, that it is not intended to limit the invention to the particular form disclosed, but on the contrary, the invention is to cover all modifications, equivalents, and alternatives falling within the spirit and scope of the invention as defined by the appended claims.

What is claimed is:

1. A method for supporting or handling diamonds and other gemstones comprising the steps of:

providing a stoneholder for handling said diamonds and other gemstones, said stoneholder comprising a pair of clasping members, each of said clasping members comprising a pair of stone support members having proximal and distal ends, said stone support members of each clasping member being separated by an aperture and being joined at the distal end by a bend which is substantially circular in shape and which forms a seat for supporting a cutlet of a stone; and a pair of mounting means, each mounting means being fixed to the proximal end of said stone support members, said mounting means being operatively coupled such that said clasping members oppose each other and are movable toward and from each other; and grasping a diamond or other gemstone between said pair of clasping members.

* * * * *